United States Patent [19]

Platel

[11] 4,449,243

[45] May 15, 1984

[54] VACUUM PACKAGE BAG

[75] Inventor: Charles Platel, Marck, France

[73] Assignee: Cafes Collet, Calais, France

[21] Appl. No.: 415,739

[22] Filed: Sep. 7, 1982

[30] Foreign Application Priority Data

Sep. 10, 1981 [FR] France ..... 81 17160

[51] Int. Cl.[3] ..... B65D 33/01

[52] U.S. Cl. ..... 383/103; 426/106; 426/118; 426/410; 53/434; 206/524.8

[58] Field of Search ..... 426/118, 410, 126, 127, 426/112, 106, 394, 395, 413; 383/100, 101, 103, 44, 45, 46, 53, 121; 53/432–434, 512, 511, 410; 206/524.8; 229/DIG. 14

[56] References Cited

U.S. PATENT DOCUMENTS

| | | | |
|---|---|---|---|
| 2,870,954 | 1/1959 | Kulesza | 426/118 |
| 3,133,691 | 5/1964 | Corbett | 229/DIG. 14 |
| 3,149,772 | 9/1964 | Olsson . | |
| 3,237,844 | 3/1966 | Hughes | 383/103 |
| 3,516,217 | 6/1970 | Gildersleeve | 53/432 |
| 3,833,166 | 9/1974 | Murray . | |
| 3,843,806 | 10/1974 | Kishpaugh et al. | 426/106 |
| 3,937,395 | 2/1976 | Lawes | 229/DIG. 14 |
| 4,069,349 | 1/1978 | Shaw | 426/410 |

FOREIGN PATENT DOCUMENTS

| | | | |
|---|---|---|---|
| 72284 | 10/1957 | France . | |
| 1169214 | 3/1957 | United Kingdom . | |
| 855313 | 11/1960 | United Kingdom | 53/434 |
| 951228 | 3/1964 | United Kingdom | 53/434 |

*Primary Examiner*—Steven L. Weinstein

*Attorney, Agent, or Firm*—Frost & Jacobs

[57] ABSTRACT

A vacuum package bag, e.g., for ground coffee, comprises opposite walls having a gas exhaust valve running along one end of the bag and formed by two parallel transverse weld lines defining a channel at least 5 mm wide. At least one gap is formed in the inner weld line at the upstream end of the channel to define a passageway between the bag and the channel, and an opening is formed at the downstream end of the channel for communication with the surrounding atmosphere. The weld lines have at least one pair of inwardly projecting protuberances defining narrowed sections of the channel. A spot weld is provided along the longitudinal axis and substantially along the continuation of the upstream oblique sides of each pair of protuberances and preferably slightly downstream thereof. Supplementary webs define converging passages between the downstream-most passageway and the upstream-most pair of protuberances.

7 Claims, 1 Drawing Figure

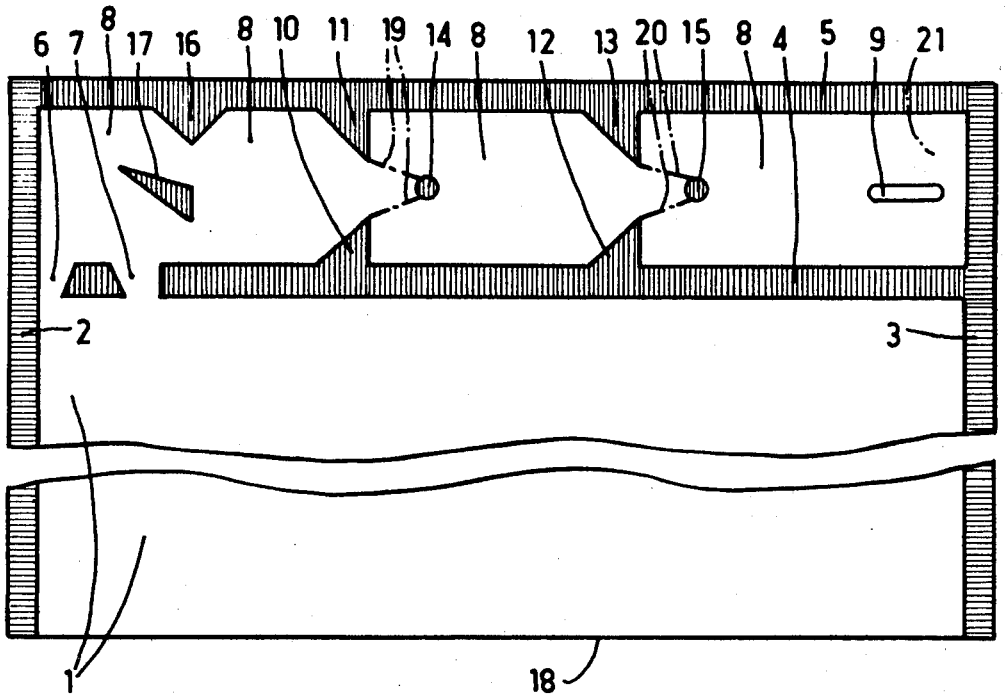
6
7
8
17
16
8
10
11
19
14
8
12
13
20
15
8
4
5
9
21
2
3
1
18

VACUUM PACKAGE BAG

FIELD OF THE INVENTION

The present invention relates to plastic vacuum package bags comprising along their edges, a valve closure for exhausting gases therefrom while preventing the external atmosphere from returning after the gases are exhausted.

Such bags may be used for packaging the widest range of materials in powder form, beans or grains, pieces or slices of variable dimensions. They are particularly useful for packaging ground or unground roasted coffee beans.

PRIOR ART

Various models of such bags have already been proposed. French Pat. No. 1,169,214 discloses a bag comprising a flattened flexible plastic tube having one end sealed by a transverse weld or heat seal extending along the entire width of the bag. The opposite end is provided with two parallel transverse weld lines, each having a gap adjacent one of the sides of the bag, the two welded zones or gaps thus defined being formed at different ends of the welds. The certificate of addition No. 72,284 to the above mentioned French patent proposes a bag of the same type in which only the weld line remote from the end of the bag which it closes has a gap adjacent to one of its ends. The other weld line extends across the entire width of the bag. An orifice is formed in at least one of the walls of the bag between the weld lines and proximate to the side of the bag opposite the side close to the unwelded zone or gap in the first mentioned weld line.

In both cases when the filled bag is closed and put under partial vacuum, for example, by being placed in a vacuum chamber, the air and any other gases contained in the bag are exhausted through the gap in the first weld line and then through the channel formed by the gap between the two parallel weld lines, then through the gap in the second weld line or through the orifice defined between the two welds in the wall of the bag. Once the air and any other gases have been extracted from the bag and the channel between the welds, the walls of the bag defining the channel are urged tightly against each other by the external pressure and the external atmosphere is thus prevented from entering the bag along the reverse path when the negative pressure in the chamber is removed and chamber is opened. In practice, first the bags are formed, providing the parallel transverse weld lines defining the valve, then each bag is filled before closing it with a weld line located on the side opposite the valve, and the bags are introduced into the vacuum chamber after they are completely filled. Once the bags are under negative pressure, they are removed from the chamber after relieving the pressure in the latter and, if desired, a safety weld may be provided for permanently sealing the channel formed between the two weld lines.

Originally the two weld lines defining the valve were at a distance of about 2 mm from each other. However, difficulties arose in certain cases owing to the very narrow width of the walls of the channel having the tendency to come too close together and interfere with the free exhausting of the gases contained in the bag. Such was the case particularly when the bag was subjected to successive applications of nenative pressure, with intervals therebetween, permitting the degassing of their contents. This led to adopting a wider channel which gave rise to the opposite drawback, i.e., an irregular closure of the valve. The latter drawback was sought to be overcome by short weld lines transverse of the channel, extending alternately from each of the weld lines defining the channel partway across the channel so as to form a series of baffles. This arrangement did not yield the sought-after results.

On the other hand, when the product contained in the bag is in pulverulent form, which is the case with ground coffee, for which the bag according to the invention is particularly advantageous, the product tends to be entrained by the gaseous stream through free passageway between the bag and the channel and into the latter especially when the exhausting of gases from the bag to the atmosphere is enhanced by a wider channel. Although only relatively small amounts of the product are entrained, the entrained particles tend to prevent the walls of the bag delimiting the channel from bearing perfectly against each other thereby prejudicing the operation of the valve which the channel comprises.

OBJECTS AND SUMMARY OF THE INVENTION

An object of the invention is to provide a bag of the foregoing kind having an exhaust valve which operates entirely satisfactorily, permitting the gases in the bag to be fully exhausted while preventing the return of the external atmosphere into the bag after it is exhausted.

Another object is to provide a bag of this type in which the amount of pulverulent materials entrained in the channel defining the valve is reduced to a minimum.

According to the invention there is provided a vacuum package comprising a gas exhaust valve extending along one end of the bag. The gas exhaust valve is formed by inner and outer parallel transverse weld lines defining a channel at least 5 mm wide therebetween. The inner weld line has at least one gap in the vicinity of one side of the bag defining a passageway between the interior of the bag and an upstream end of the channel. An opening is provided in the vicinity of the opposite side of the bag for bringing a downstream end of the channel into communication with the surroundings. The improvement comprises: each of the transverse weld lines has at least one first protuberance disposed between the gap in the inner weld line and the opening and at least one second protuberance facing and symmetrical to the first protuberance with respect to the longitudinal axis of the channel. The first and second protuberances define a narrowed section of the channel. Each of the protuberances has an oblique upstream side and a downstream side substantially perpendicular to the weld lines. A spot weld is arranged along the longitudinal axis of the channel to attach the opposite walls of the bag substantially at the point of intersection of the continuation of the oblique sides of the first and second protuberances.

Preferably, there are at least two pairs of first and second protuberances defining at least two said narrowed sections of the channel. The spot welds are advantageously slightly downstream of the actual point of continuation of the oblique sides of the associated pair first and second protuberances.

As will be brought out in detail hereinbelow, the combination of the narrowed sections or throats and the spot welds associated therewith facilitates the exhausting of gases from the bag through the channel when under negative pressure and substantially improves the check valve effect function of the channel.

These advantages can be further enhanced by outwardly flaring the free passageway between the interior of the bag and the channel through the gap in the inner weld line. To perfect the result supplementary welds may be provided between the passageway(s) and the upstream pair of first and second protuberances, the edges of the supplementary weld forming converging passages. At least one of the supplementary welds is of elongated configuration, defining an oblique screen intersecting the axis of the free passage, the slope of oblique screen running upstream toward the upstream end of the outer weld line.

BRIEF DESCRIPTION OF THE DRAWING

An embodiment of the invention is described below with reference to the accompanying drawing in which the single FIGURE is a diagrammatic plan view of the bag lying flat before it is filled.

In the drawing, the welded portions are hatched.

DESCRIPTION OF THE PREFERRED EMBODIMENT

The present bag is, as known per se, formed by joining two rectangular flexible plastic sheets 1, joined along their longitudinal edges by weld lines or heat seals 2 and 3. The bag is closed at one end by two parallel weld lines or heat seals 4 and 5 spaced about 1 cm from each other, the inner weld 4 is closer to the body of the bag and has at least one gap at its upstream end adjacent the weld line 2 defining free passageways 6 and 7 between the body of the bag and the channel 8 defined between the inner and outer weldlines 4 and 5. At the downstream end of the channel 8 remote from the upstream end into which open passageways 6 and 7 there is an opening 9 in at least one of the sheets 1 of the bag which brings the channel 8 into communication with the surroundings.

In accordance with the invention the inner and outer weld lines 4 and 5 are locally widened by pairs of triangular protuberances 10, 11 and 12, 13 with protuberances of each pair arranged facing each other. the upstream side of each protuberance is obliquely inclined so that the pairs of protuberances define narrowed sections or throats converging downstream, i.e., toward the opening 9. The other side of each of the protuberances 10,11, and 12,13 is substantially perpendicular to the weld lines 4 and 5. Slightly downstream of the points of intersection of the extension of the oblique upstream sides of the protuberances 10,11 and 12, 13 are formed spot welds 14 and 15 which lie substantially along the longitudinal axis of center line of the channel 8.

As shown, supplementary welds comprising, in the illustrated embodiment, a triangular protuberances 16 projecting from the outer weld line 5 directly inwardly into the channel 8 and a triangular spot weld 17 disposed substantially along the longitudinal axis of center line of the channel 8. These supplementary welds 16 and 17 are arranged in the upstream part of the channel 8 between the free passageways 6 and 7 in the inner weld line 4 and the first or upstream pair of convergent protuberances 10, 11. It may be seen that the triangular welds 16 and 17 are arranged so that downstream convergent passages are formed. Also, the triangular spot weld 17 is diposed obliquely across the axis of the free passageway 7.

Assuming the product to be packaged by the bag is ground coffee, the bag is filled, with the channel 8 at the bottom, through an opening defined by the edges 18 of the sheets 1. During filling operation the bag is preferably maintained between two parallel walls arranged so that the coffee is distributed as evenly as possible in the bag, the bag being subjected to vibrations at the same time as the filling or immediately thereafter. Once the bag is filled a weld line seals the edges 18 and the bag is introduced with other identically filled bag into a chamber which is subjected to negative pressure. Air and any other gases contained in the bag are exhausted from the bag to the surrounding atmosphere through the free passageways 6 and 7, channel 8 and opening 9. The stream of gas thus formed tends to entrain particles of ground coffee through the free passages 6 and 7, but this is impeded by the divergent configuration of the passageways 6 and 7. Moreover, the supplemental spot weld 17 tends to direct the coffee particles that nevertheless make it through passageways 6 and 7 toward the downstream end of the portion of channel 8 remote from the opening 9. In addition, the forward movement of particles entrained in the channel 8 is impeded by the covergent passages defined by the supplemental welds 16 and 17.

When the gases contained in the bag are drawn through the channel 8, the pairs of protuberances 10, 11 and 12, 13 in cooperation with their respective spot welds 14 and 15 tend to form folds in the walls of the channel 8 substantially along the chain-dotted lines 19 and 20 thereby maintaining free passages for the exhausting of gases. When the gases have been exhausted, the two sheets 1 forming the bag are in intimate contact with the ground coffee contained therein and bear tightly against each other along the entire length of the channel 8. In case the partial vacuum in the chamber is broken there would be a tendency for air to return to the bags, the sheets having the tendency to separate, but under the action of the stream of air flowing from the opening 9 to the opposite end of the channel 8, the walls of the channel tend to form folds along the chain-dotted lines 19 and 20 thereby forming barriers against the flow of the gases in the undesired upstream direction.

It will be understood that the illustrated embodiment admits of variations and alternatives understood to those skilled in the art without departing from the spirit and scope of the invention. This applies in particular to the number of free passageways between the body of the bag and the channel, the number of narrowed sections formed by welds 16 or 17, as well as the configuration of such welds, and the configuration and number of the protuberances 10,11 and 12,13.

What is claimed is:

1. A vacuum package bag comprising a pair of opposite walls having a gas exhaust valve extending along one end of said bag, said gas exhaust valve being formed by inner and outer parallel transverse weld lines joining said opposite walls and defining a channel at least 5 mm wide therebetween, said inner weld line having at least one gap in the vicinity of one side of said bag defining a passageway between the interior of said bag and an upstream end of said channel, an opening being provided in the vicinity of the opposite side of said bag for bringing a downstream end of said channel into communication with the surrounding atmosphere, the improvement which comprises providing said transverse weld lines with at least one first protuberance disposed between said gap in said inner weld line and said opening and at least one second protuberance facing and symmetrical to said first protuberance with respect to the longitudinal axis of said channel, said first and second protuberances defining a narrowed section in said channel, each of said protuberances having an oblique upstream side and a downstream side substantially perpendicular to said weld lines, and a spot weld being arranged along said longitudinal axis of said channel to attach the opposite walls of said bag in the vicinity of the point of intersection of the continuation of said oblique sides of said first and second protuberances.

2. The bag defined in claim 1 wherein said spot weld is disposed slightly downstream of said point of intersection of the continuation of said oblique sides of the associated first and second protuberances.

3. The bag defined in claims 1 or 2, wherein said passageway between the interior of said bag and said channel flares outwardly toward the channel.

4. The bag defined in claims 1 or 2, further comprising supplementary welds defining edges converging in a downstream direction and arranged in the zone of said channel between a said passageway and an upstream pair of said first and second protuberances.

5. The bag defined in claim 4, wherein one of said supplementary welds is of elongated configuration and arranged to form an oblique screen crossing the longitudinal axis of said passageway, said one supplementary weld sloping upwardly toward the upstream end of said outer weld line.

6. The bag defined in claims 1 or 2, wherein fold lines are formed in said bag between said first and second protuberances and their associated spot weld, said fold lines defining a check valve preventing the return of gases from the surrounding atmosphere to the interior of said bag.

7. The bag defined in claims 1 or 2, wherein pairs of said first and second protuberances are formed in said channel at spaced apart intervals, and wherein a spot weld is associated with each of said pairs of protuberances.

* * * * *